United States Patent [19]

Walker-Taylor

[11] Patent Number: 4,524,993

[45] Date of Patent: Jun. 25, 1985

[54] BOOK ASSEMBLY

[76] Inventor: Sherry Walker-Taylor, 2283 Bayswater Dr., Kennesaw, Ga. 30144

[21] Appl. No.: 503,416

[22] Filed: Jun. 13, 1983

[51] Int. Cl.[3] ..... B42D 1/00; B42D 15/00; B42D 15/04

[52] U.S. Cl. ..... 281/46; 281/15 R; 281/17

[58] Field of Search ..... 283/61, 62, 63; 281/2, 281/46, 5, 17; 434/84, 85; 282/11.5 R

[56] References Cited

U.S. PATENT DOCUMENTS

| | | | |
|---|---|---|---|
| 151,965 | 6/1874 | Forbinger | D16/1 |
| 802,031 | 10/1905 | Eschenbach | 434/84 |
| 1,206,795 | 12/1916 | Barrington | 283/1 R |
| 1,306,691 | 6/1919 | Goetz | 281/5 |
| 1,958,058 | 5/1934 | McCleary | 281/17 |
| 2,044,760 | 6/1936 | Anderson | 281/3 R |
| 2,245,339 | 6/1941 | Harris et al. | D19/61 |
| 2,427,612 | 8/1947 | Lobb | 434/88 |
| 3,605,287 | 9/1971 | Jonesi | D19/59 |
| 4,176,473 | 12/1979 | Rae | 281/15 R |

FOREIGN PATENT DOCUMENTS

| | | | |
|---|---|---|---|
| 735311 | 11/1932 | France | 281/5 |
| 249295 | 7/1926 | Italy | 281/5 |
| 4796 | of 1905 | United Kingdom | 434/84 |

*Primary Examiner*—Paul A. Bell
*Assistant Examiner*—Paul M. Heyrana, Sr.
*Attorney, Agent, or Firm*—Newton, Hopkins & Ormsby

[57] ABSTRACT

A large rectangular sheet is subdivided into successive sheets joined along common fold line edges to produce an accordian, folded book in which pairs of the smaller sheets form successive pages and the successive pages are joined side-by-side by the successive fold lines. A binder joins the rear fold line edges of the sheets together and a perforation line extending parallel to the upper and lower edges of each of the sheets provides a means by which the book can be torn in two. Instruction indecia are placed in the upper panels and the lower panels of each sheet are blank so that a child may illustrate the instructions on these blank panels.

5 Claims, 5 Drawing Figures

BOOK ASSEMBLY

BACKGROUND OF THE INVENTION

1. Field of the Invention

This invention relates to a book assembly and is more particularly concerned with a book capable of being illustrated by the reader.

2. Description of the Prior Art

In the past numerous coloring books of various types have been devised for children so that the children may color outlined areas so as to produce a picture. Such conventional coloring books are quite widely used and are well known. The coloring books, however, do not require a child to think or create his own illustrations but rather simply require the child to fill in predefined areas.

SUMMARY OF THE INVENTION

Briefly described, the present invention includes a relatively large unitary rectangular sheet which is subdivided into a plurality of smaller juxtaposed rectangular sheets of paper, joined by their edges, so as to produce an accordian type continuous structure. This structure is perforated for tearing along its central portion in a straight continuous line from one end to the other, in a direction essentially parallel to the upper and lower edges of the sheets. The sheets are then bound with a removeable binder along one side so as to produce a book. This book has instruction indecia on each sheet, above the perforation line, and is provided with a blank area, below the perforation line so that, on each page, after the title page, the instructions for illustrating that page are in the upper portion of the sheet and an area therebelow is provided on which the illustration is placed by the reader. When the illustration is completed, the backing or binder is removed from the book and the sheets are torn along the perforation line so that the lower portion of the accordian structure, which now contains a continuous picture, can be displayed and is the handiwork of the reader.

Accordingly, it is an object of the present invention to provide a book assembly which can be illustrated by the reader, the book assembly being inexpensive to manufacture and durable in structure.

Another object of the present invention is to provide a book assembly which can be illustrated totally by the reader pursuant to instructions contained in the book and which, when the illustrations are completed, can be removed from the instructions so that it can be displayed as a continuous illustration.

Another object of the present invention is to provide a book assembly which has an instruction area and an area for illustrating and in which the area for illustrating can be removed totally from the instructions, after the instructions have served their useful purpose.

Other objects, features and advantages of the present invention will become apparent from the following description when taken in conjunction with the accompanying drawings wherein like characters of reference designate corresponding parts throughout the several views.

DESCRIPTION OF THE PREFERRED EMBODIMENT

Figure 1:
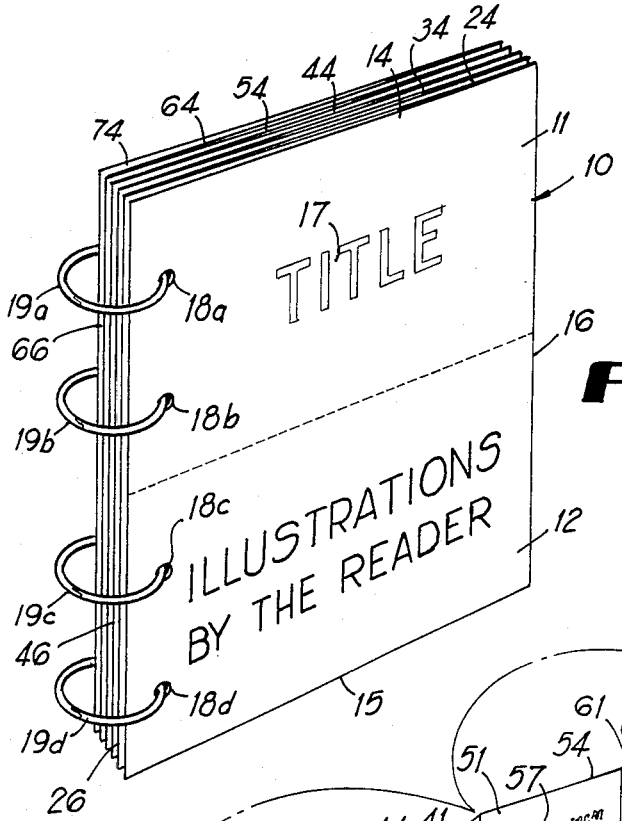
FIG. 1 is a perspective view of a book assembly constructed in accordance with the present invention.
Figure 2:
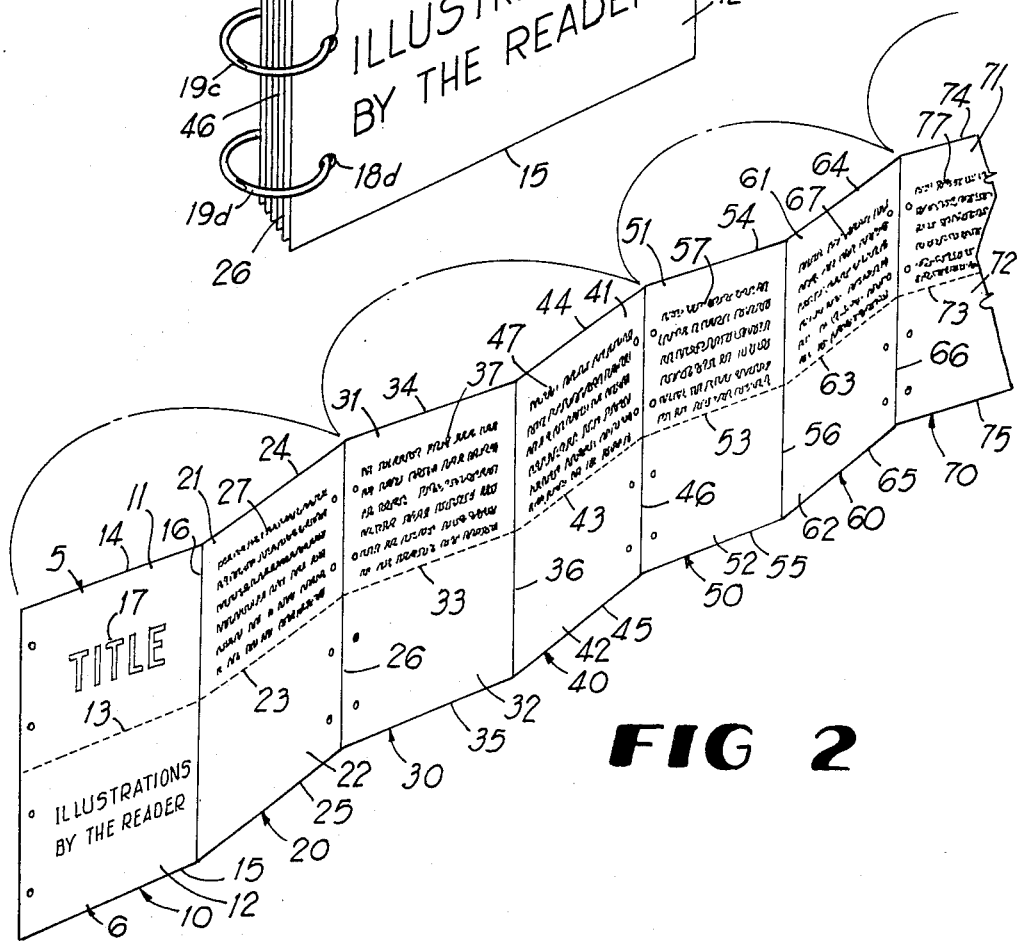
FIG. 2 is a fragmentary perspective view of the sheets of the book assembly illustrated in FIG. 1, the sheets being extended; and FIGS. *3a*, *3b* and *3c* are plan views of blank area portions of the sheets which have been illustrated and removed from the remainder of the book assembly.

Referring now in detail to the embodiment chosen for the purpose of illustrating the present invention, numeral 5 denotes a relatively large unitary rectangular sheet, preferrably formed of cardboard, fiber board or the like. The large sheet 5 is subdivided along its length into a plurality of equal size page sheets or panels which, each have a length equal to the width of large sheet 5 and a width defined by the ends of the large sheet and spaced fold lines which are parallel thereto. Thus, the first sheet or panel forms the title page or front page 10 which is a rectangular member having juxtaposed upper rectangular panel or sheet 11 and lower rectangular panels or sheets 12, the sheets 11 and 12 being separated by a horizontal perforation line 13. Perforation 13 is usually disposed along the central portion of sheet 10 so as to be parallel to the upper edge 14 of sheet 10 and also parallel to the lower edge 15, thereof. The forward edge 16 of the sheet 10 is the first of a series of equally spaced score lines or fold lines which extend vertically between the upper and the lower edges of the large sheet.

The second sheet or panel 20 is attached to sheet 10 along the common edge 16 and is a rectangular sheet of identical proportions to the sheet 10 and also a subdivision of sheet 5. This rectangular sheet or panel 20 includes an upper edge 24 and a lower edge 25 which are extensions of edges 14 and 15 respectively. The front edge 16 of sheet or panel 10 is also the front edge of sheet 20. The sheet 20 is folded flat against the sheet 10 so that their back surfaces are adjacent or contiguous. Sheet 20 has a score line or fold line forming rear edge 26. Edge 26 also forms the rear edge of a sheet 30, the sheet 30 having a score line or fold line for front edge 36 which forms a common edge for the successive sheet 40. In addition, there are edges 46, 56, 66, etc., which are score lines or fold lines forming common edges for the adjacent accordian sheets, thus provided, the rear edge 46 being common to sheets 40 and 50, the front edge 56 being common to sheets 50 and 60 and the rear edge 66 being common to sheets 60 and 70. The top edges 14, 24, 34, 44, 54, 64 and 74 are disposed in a common plane which is parallel to the plane of the bottom edges 15, 25, 35, 45, 55, 65 and 75.

Successive sheets 20, 30, 40, 50, 60 and 70 are respectively provided with straight perforations or perforation lines 23, 33, 43, 53, 63 and 73, respectively, which are a continuation of perforation 13, the perforations being preferably midway between the edges of the respective sheets. Thus, each sheet 20, 30, 40, 50, 60, 70 is divided by its perforation into an upper panel 21, 31, 41, 51, 61, 71 and lower panel 22, 32, 42, 52, 62, 72.

When the side-by-side, joined successive sheets 10, 20, 30, 40, 50, 60 and 70 are collapsed into a book, sheets 10 and 20 form a pair of back to back sheets, sheets 30 and 40 form a pair of back to back sheets, etc. The alternate edges 16, 36, 56, etc., form the front edges of the adjacent sheets while the alternate edges 26, 46, 66, etc., form the rear edges of the abutting sheets, the sheets 20 and 30 facing each other and the sheets 40 and 50 facing each other and the sheets 60 and 70 facing each other.

Any removeable binder can be employed for holding the back edges of sheets 10, 20, 30, 40, 50, 60 and 70 together, in book form, as shown in FIG. 1. For purpose of illustration, I have shown that these sheets are provided with four spaced, vertically aligned openings or holes 18*a*, 18*b*, 18*c* and 18*d* along the rear edge 6 of the title page. In like fashion, adjacent to each of the rear edges 26, 46, 66, etc., there are similar holes 28, 38, 48, 58, 68 and 78. Thus, when the sheets 10, 20, 30, 40, 50, 60 and 70 of the book are assembled, in collapsed condition, these holes are respectively aligned with the holes 18*a*, 18*b*, 18*c*, and 18*d* so as to receive binder rings 19*a*, 19*b*, 19*c* and 19*d* therethrough. It will be understood there are other types of back binders which can be substituted for the binder rings, 18*a*, 18*b*, 18*c*, 18*d*, if desired. Removeable plastic backs (not shown) which slide onto and off of edge portions of sheets can be substituted for the rings, if desired. Also other binder means such as adhesive, or tape, or the like, which yieldably hold the back edges together can be employed as the means for removeably binding the rear edges, together.

Figure 3A:
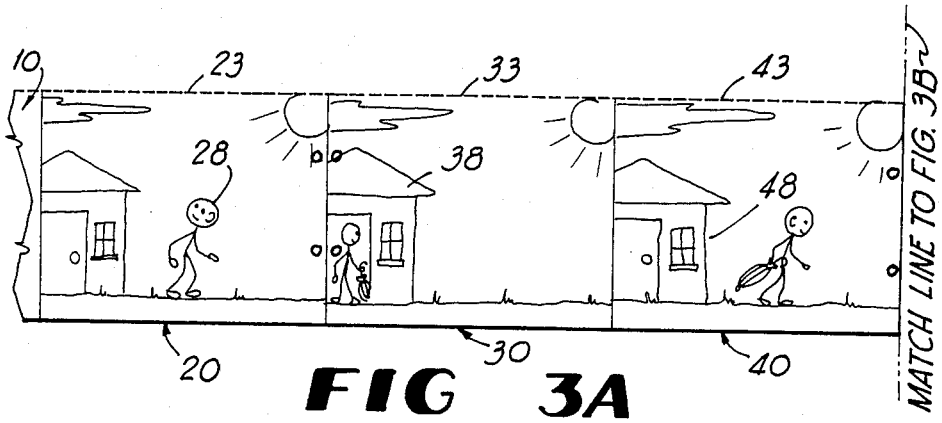
Figure 3B:
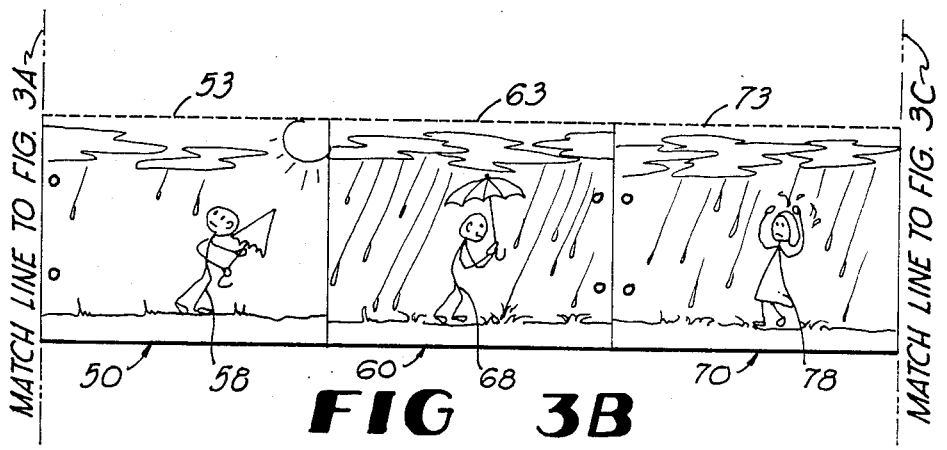
Figure 3C:
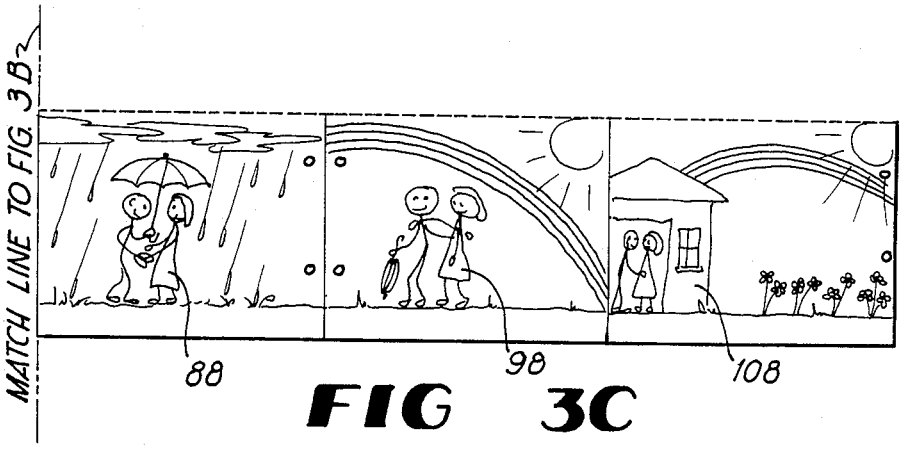

From the foregoing description the operation of the present book assembly should be apparent. The first sheet 10 is printed with a title 17 along its upper panel 11 and the sheets 20, 30, 40, 50, 60 and 70 are provided with instruction indecia 27, 37, 47, 57, 67 and 77 in the respective upper panels 21, 31, 41, 51, 61, 71 of these sheets. Thus, all instructional material is contained in this upper panel between the perforations 23, 33, 43, 53, 63 and 73 and the upper edges 24, 34, 44, 54, 64 and 74. The lower panel or sheet 22, 32, 42, 52, 62, 72, are intentionally left blank. Therefore, when a child turns to the first page, after the title page of the book illustrated in FIG. 1, he sees instructions 27 which tells him what picture 28 to draw on puzzle. Next, he proceeds to the next page which is sheet 30 and reads instruction 37 as to the type of drawing or illustration 38 to make on panel 32. This proceeds with the child sequentially filling in the respective blank panels or sheets with illustrations 48, 58, 68, 78, 88, 98 and 108 as depicted in FIGS. 3*a*, 3*b* and 3*c*.

When the child has completed all illustration 28, 38, 48, 58, 68, 78, 88, 98 and 108, he tears the book in two along the perforations 13, 23, 33, 43, 53, 63, 73, etc. Thus is produced the illustration as depicted in FIGS. 3*a*, 3*b* and 3*c*. When the lower half of the large sheet 5 which has received the illustrations, is laid flat, as indicated in FIGS. 3*a*, 3*b* and 3*c*, it shows a continuous illustration and, indeed, if desired, the illustration can be carried forward from one page to the next, etc. Of course, before the lower portions can be laid out, the binder rings 19*a*, 19*b*, 19*c* and 19*d* must be removed from their holes.

The resulting picture or succession of pictures, which may extend for any desired length, is entirely separate from the instructions and therefore gives no indication on the picture itself, that it was devised following instructions in a book. The book assembly of the present invention, therefore, encourages a child to do original work and to illustrate, using his own thoughts, what should be on the particular sheet.

It will be obvious to those skilled in the art that many variations may be made in the embodiment here chosen for the purpose of illustrating the present invention without departing from the scope of the invention as defined by the claims.

I claim:

1. A book assembly comprising a plurality of rectangular sheets joined in accordian fashion, in succession along successive spaced parallel fold lines each fold line forming a common edge for the next adjacent of said sheets, the first common edge being a front edge and the next common edge being a rear edge and alternating front and rear edges thereafter, adjacent pairs of said sheets being folded against each other so that a first side of the pair of sheets are adjacent to each other with the common edge between that pair of sheets forming a one of the front or rear edges whereby when the sheets are collapsed, the sides of the pairs of sheets form successive pages of the book, the trailing edge of sheets of the pairs of sheets being joined respectively to the leading edge of the sheets of the following pairs of sheets along rear edges, said sheets being provided with perforation lines extending between the front edge and rear edge of each sheet for separating each sheet into an instruction area panel and a blank work sheet area panel, and printed indicia on said instructional area panel, the blank sheet area panels providing space for illustrations in seriatim and being removeable from the instructional area panels along said perforation lines after completion of the illustrations so that the work area panel may be separated from the instruction area panels to form a continuous display sheet of the work area panels in seriatim.

2. The book assembly defined in claim 1 including detachable binding means adjacent to the rear edges of said sheets for binding the rear portions of said sheets together.

3. The book assembly defined in claim 1 wherein said perforation lines of each sheet are aligned in a continuous line parallel to the top and bottom edges of said sheets.

4. The book assembly defined in claim 1 wherein said sheets are each of approximately the same size and dimensions whereby alternate fold lines are disposed adjacent to each other in succession when said sheets are collapsed against each other.

5. A book assembly comprising a plurality of juxtaposed rectangular sheets folded in succession along spaced parallel fold lines and arranged in stacked relationship, binding means for binding the edges of said sheets to form a book, said sheets being provided with perforation lines extending between the front edge and rear edge of each sheet for separating each sheet into an instruction area panel and a blank work sheet panel, and printed indicia on said instructional area panel for instructing the reader on his own illustration, the blank sheet area panels providing space for illustrations in seriatim and being removeable from the instructional area panels along said perforation lines, said binding means being detachable so that the work area panels may be separated from the instruction area panels along the perforation lines after completion of the illustrations to form a continuous display of the work area panels in seriatim.

* * * * *